US005370442A

United States Patent [19]

Saul et al.

[11] Patent Number: 5,370,442

[45] Date of Patent: Dec. 6, 1994

[54] ROCKER BLOCK

[75] Inventors: Jonathan R. Saul, LaSalle; Karl J. Komorowski, Petersburg; Larry P. LaPointe, Temperance, all of Mich.

[73] Assignee: La-Z-Boy Chair Co., Monroe, Mich.

[21] Appl. No.: 68,057

[22] Filed: May 27, 1993

[51] Int. Cl.[5] ..... A47C 3/027

[52] U.S. Cl. ..... 297/261; 297/267; 297/DIG. 2; 297/272

[58] Field of Search ..... 297/258, 261–267, 297/272, 423.43, DIG. 2, DIG. 7; 248/133, 139, 143, 371, 396

[56] References Cited

U.S. PATENT DOCUMENTS

| | | | |
|---|---|---|---|
| 448,240 | 3/1891 | Kade . | |
| 2,528,331 | 10/1950 | Bell . | |
| 2,772,723 | 12/1956 | Tunnell . | |
| 2,813,574 | 11/1957 | Hawkins . | |
| 2,871,916 | 2/1959 | Fox . | |
| 2,907,373 | 10/1959 | Katz | 297/DIG. 7 X |
| 3,053,570 | 9/1962 | Fox . | |
| 3,190,693 | 6/1965 | Underdown, Sr. . | |
| 3,300,244 | 1/1967 | Hughes . | |
| 3,415,531 | 12/1968 | Kiel . | |
| 3,547,393 | 12/1970 | Gordin . | |
| 3,840,205 | 10/1974 | Faull . | |
| 3,881,713 | 5/1975 | Joyce . | |
| 3,887,234 | 6/1975 | Curtis et al. | 297/DIG. 2 X |
| 3,966,251 | 6/1976 | Belisle . | |
| 4,079,991 | 3/1978 | Harris | 297/272 X |
| 4,092,041 | 5/1978 | Landry et al. | 297/DIG. 7 X |
| 4,810,032 | 3/1989 | Gibson . | |

*Primary Examiner*—Peter R. Brown

*Attorney, Agent, or Firm*—Harness, Dickey & Pierce

[57] ABSTRACT

A rocker block for use in a rocking-type chair having a base assembly and an upholstered chair frame. The rocker block is adapted for mounting to a lateral side of the chair frame's lower frame structure and has an arcuate surface engageable with the base assembly for enabling rocking movement of the chair frame relative to the base assembly. The rocker block is a molded plastic component having an alignment arrangement formed thereon for engaging a portion of the lower frame structure. In addition, a first set of apertures are formed in the rocker block for receiving suitable fasteners so as to rigidly secure the plastic rocker block to the lower frame structure. Likewise, a second set of apertures are provided for receiving suitable fasteners to couple a rocker spring mechanism to the plastic rocker block. The plastic rocker block overcomes disadvantages associated with wooden components and provides the requisite rigidity and load-bearing strength to promote enhanced rocking action.

20 Claims, 4 Drawing Sheets

FIG 1
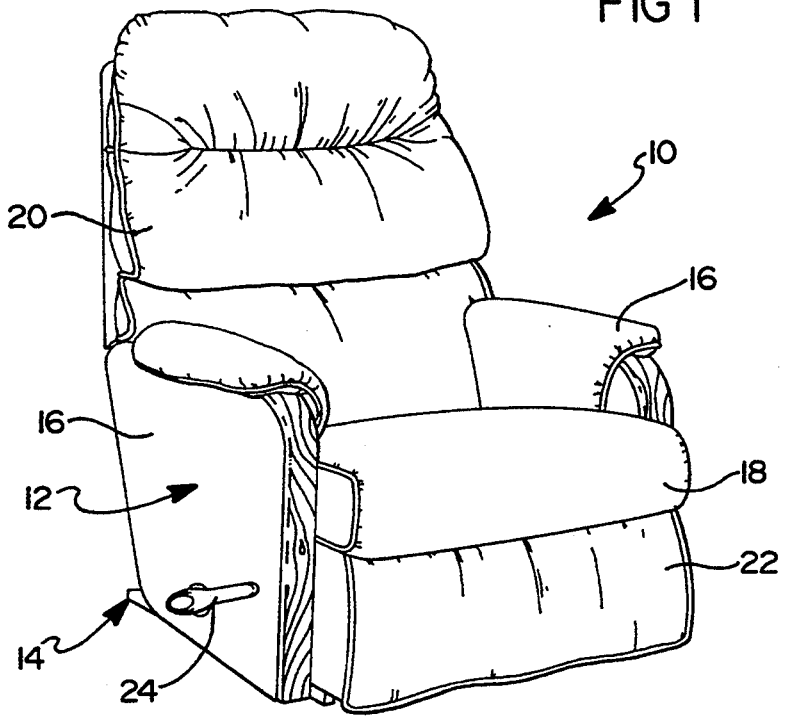
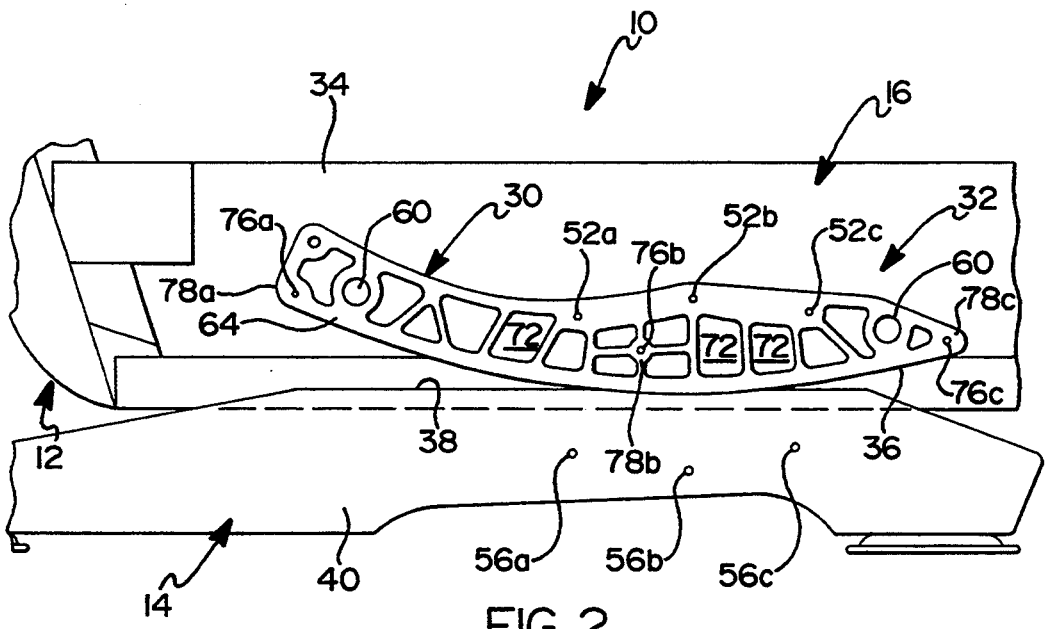
FIG 2

ROCKER BLOCK

BACKGROUND OF THE INVENTION

The present invention relates generally to platform rocking chairs and, more particularly, to an improved rocker block for facilitating rocking movement of an upholstered chair frame on a stationary base assembly.

As is well known, platform rocking chairs are generally categorized by an upholstered chair frame which is supported for rocking movement from a stationary base assembly. Typically, a rocker block is secured to each lateral side of the chair frame and has an arcuate surface which is seated for rolling movement on a planar surface of the base assembly. Thus, any rocking movement of the chair frame is caused in response to rolling movement of the rocker blocks on the base assembly. It is also common to interconnect a rocker spring mechanism between each rocker block and the base assembly for controlling the amplitude and balance of the chair's rocking movement as well as for normally retaining the chair in an upright position.

Traditionally, conventional rocker blocks have been fabricated from solid blocks of wood. Most commonly, the rocker blocks are made from hardwoods such as oak, elm, maple or alder. The wooden rocker blocks are typically fixed to the chair's lower frame structure utilizing a combination of dowel pins and adhesives and/or fasteners to ensure proper alignment and rigidity. As such, a secondary clamping or "pressing" operation is employed during assembly of the chair frame to accommodate complete curing of the adhesive. However, prior to such assembly, the wooden rocker blocks are pre-drilled to provide a series of mounting apertures for subsequent interconnection of the rocker spring mechanism thereto. As will be appreciated, the location of each rocker block to its corresponding lateral side of the chair frame and its location with respect to the other rocker block must be precise for permitting the rocker spring mechanisms to provide a proper alignment and balancing of the chair at rest and during rocking movement.

While conventional wooden rocker blocks have performed satisfactorily for their intended purpose, the ever increasing cost and lack of availability of high quality hardwood materials is a major concern for furniture manufacturers. Moreover, in an effort to deproliferate the number of independent chair frames currently produced for various models of chairs, furniture manufacturers have begun utilizing modular frame components and assembly techniques which can be used for assembling "universal" chair frames for use in both rocker and non-rocker type chairs. However, the secondary clamping operation currently employed for mounting the rocker blocks to the chair frame severely limits the application of the above-noted modularity concepts. To this end, the need exists to develop alternatives to wooden rocker blocks which overcome the noted disadvantages and concomitantly provide improved strength, smoother balanced rocking motion and which can be precisely located and secured during modular assembly.

SUMMARY OF THE INVENTION

Accordingly, it is an object of the present invention to provide a non-wooden rocker block for use in platform-type rocking chairs. In a preferred form, the non-wooden rocker block is fabricated from a rigid and durable plastic material. One such material that has been found to be satisfactory for molding the non-wooden rocker block of the present invention is a nylon or fiberglass-filled nylon material.

As a related object, the plastic rocker block has an arcuate contact surface which exhibits a self-lubricating characteristic for promoting smoother and quieter rocking movement relative to the stationary base assembly.

An additional object of the present invention involves the ability to quickly and simply secure the plastic rocker block to a universal side frame member for modular assembly of a rocking-type chair frame. The plastic rocker block further include means for permitting precise fixation thereof to the side frame member for enhancing the balanced rocking movement of the rocking chair.

Further objects, advantages and novel features of the present invention will be apparent from the following description, reference being made to the accompanying drawings wherein preferred embodiments of the present invention are clearly shown.

BRIEF DESCRIPTION OF THE DRAWINGS

FIG. 1 is a pictorial view of an exemplary platform rocking chair incorporating the novel features of the present invention;

FIG. 2 is a cross-sectional side view of a portion of the rocking chair shown in FIG. 1 illustrating the improved rocker block of the present invention operably supporting a chair frame for rocking movement relative to a stationary base assembly;

DESCRIPTION OF THE PREFERRED EMBODIMENTS

Figure 3:
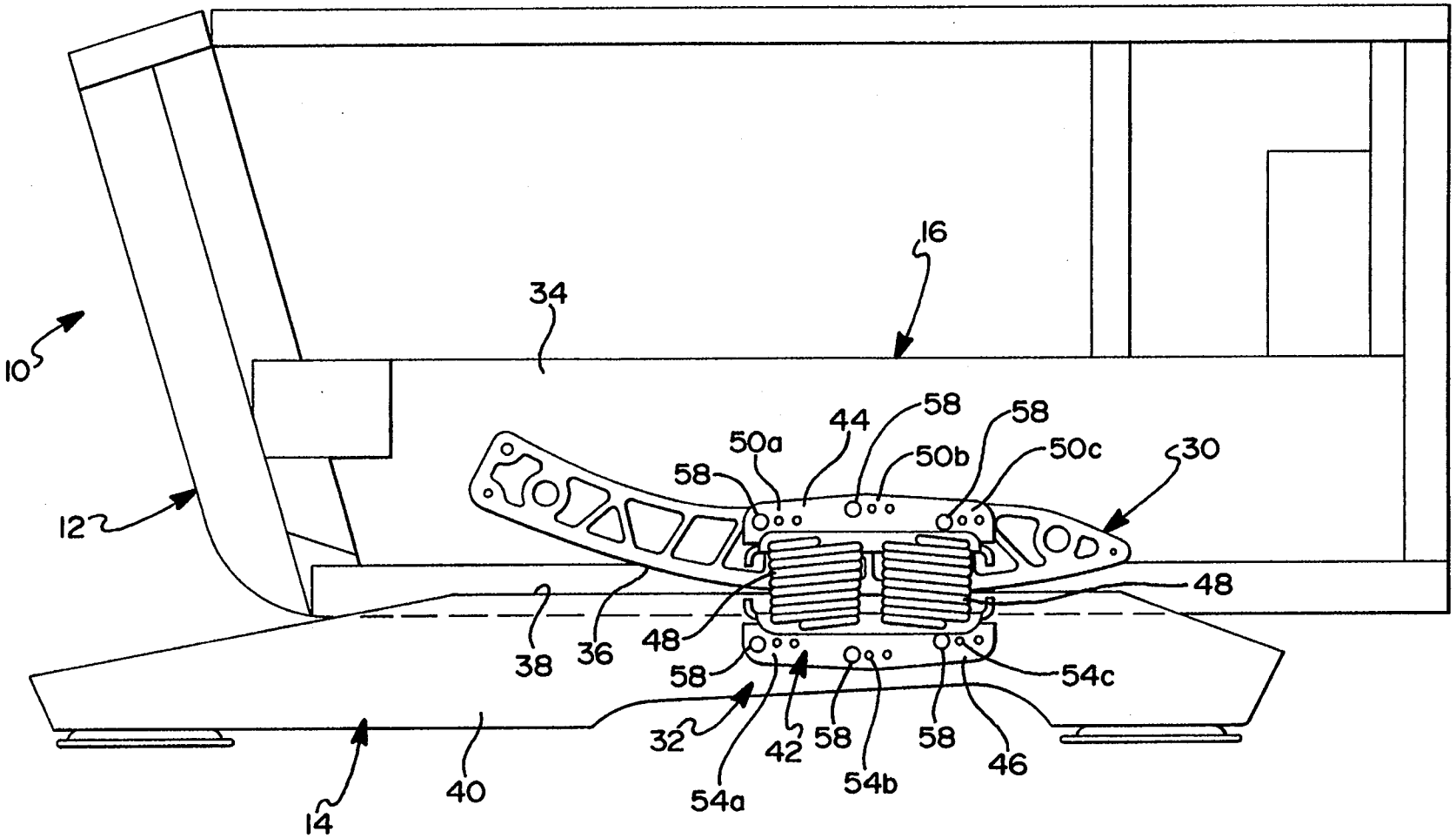
FIG. 3 is a side view, similar to FIG. 2, showing an exemplary rocker spring mechanism secured between the rocker block and the stationary base assembly.

With reference to the drawings, and particularly to FIG. 1, an exemplary platform-type rocking chair 10 is shown to include an upholstered chair frame 12 that is supported for rocking movement from a stationary platform-type base assembly 14. Upholstered chair frame 12 includes a pair of side frame members 16 which are interconnected in a conventional manner to provide a rigid box-like chair frame 12. A seat member 18 and a seatback member 20 are supported between side frame members 16 to define a seat assembly. The seat assembly may be fixed with respect to chair frame 12 or may be supported therefrom for reclining movement via any suitable reclining mechanism. In addition, rocking chair 10 is also shown to include an extensible leg rest assembly 22 that can be moved between the retracted or "stowed" position shown and an extended or "operative" position in response to manual actuation of a suitable drive mechanism, such as by handle 24.

In general, the present invention is directed to incorporation of improved rocker blocks 30 into a rocking mechanism 32 within rocking chair 10 for overcoming the above-noted shortcomings associated with otherwise conventional rocker blocks made from wood. To this end, rocker blocks 30 are preferably fabricated from a non-wooden material such as, for example, a plastic material. More preferably, plastic materials that have been found to be suitable for rocker blocks 30 are nylon or a fiberglass-filled nylon composition. Thus, while rocker blocks 30 are hereinafter referred to generally as being fabricated from "plastic", it is to be understood that virtually any non-wooden material possessing the requisite strength, rigidity and load-bearing and lubricity characteristics can be used. Moreover, the term "plastic" is also intended to define any classification of material(s) which can be formed in a molding operation in a highly-precise and repetitive manner.

With particular reference now to FIGS. 2 through 5, a first embodiment of rocker blocks 30 will now be described in association with one lateral side of chair frame 12 and base assembly 14. However, it will be appreciated that a rocker block 30 is provided at each lateral edge to support chair frame 12 for rocking movement relative to stationary base assembly 14. As best seen from FIGS. 2 and 3, plastic rocker block 30 is fixed to a lower frame portion 34 of side frame member 16 and includes an arcuate contact or "rocking" surface 36 which is seated for rolling movement on a planar surface 38 of a lateral rail member 40 of platform base 14. As will be detailed, rocker block 30 is fixed to side frame member 16 without adhesives by utilizing a dowelling arrangement and suitable threaded fasteners which extend through a series of alignable apertures and bores formed in lower frame portion 34 and rocker block 30.

To provide means for controlling the rocking movement of chair frame 12 on base assembly 14, a rocker spring apparatus 42 couples rocker block 30 to lateral rail member 40. Rocker spring apparatus 42 includes an upper bracket 44, a lower bracket 46 and a plurality of coil spring 48 disposed therebetween. Preferably, rocker spring apparatus 42 is similar to the apparatus disclosed in commonly owned U.S. Pat. No. 5,171,000, the disclosure of which is expressly incorporated by reference herein. As seen from FIGS. 2 and 3, upper bracket 44 includes three sets of mounting apertures 50*a*, 50*b* and 50*c* which are adapted to permit adjustable alignment with respect to bores 52*a*, 52*b* and 52*c* formed in rocker block 30. Similarly, lower bracket 46 includes three sets of mounting apertures 54*a*, 54*b* and 54*c* which are likewise adapted to permit adjustable alignment with respect to bores 56*a*, 56*b* and 56*c* formed in lateral rail member 40 of platform base 14. As clearly detailed in the above-noted patent, rocker spring apparatus 42 is adapted to be adjustably secured with conventional fasteners, such as threaded fasteners 58, to rocker block 30 and rail member 40 in a manner facilitating its use with virtually any rocking-type chair frame and platform-type base combination. However, it will be appreciated that rocker spring apparatus 42 is merely exemplary of only one such mechanism that is suitable for use with the present invention.

Figure 5:
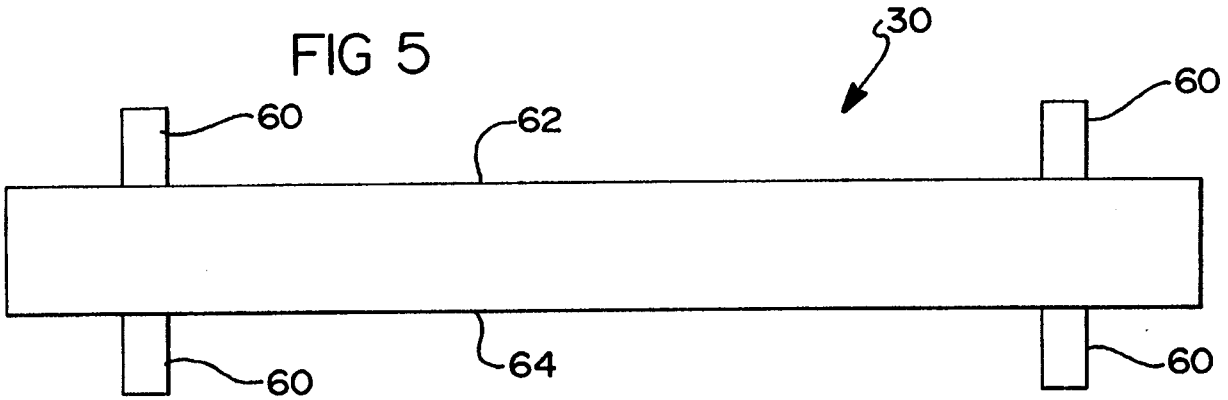
FIG. 5 is a top view of FIG. 4.
Figure 4:
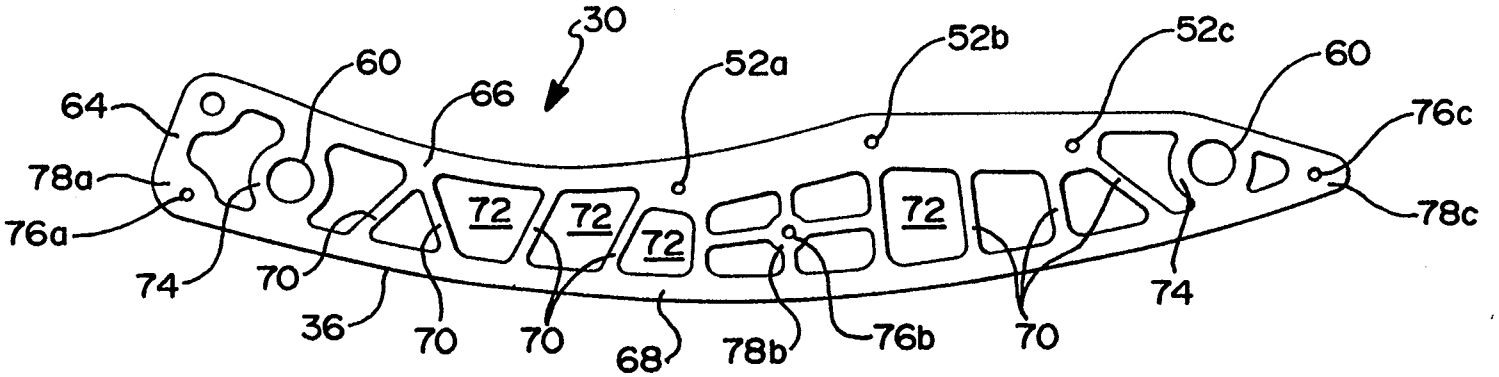
FIG. 4 is an enlarged side view of the rocker block shown in FIGS. 2 and 3.

Rocker block 30 is shown in FIGS. 4 and 5 to be of a universal design for fixation to either of the left or right side frame members 16. More particularly, rocker block 30 includes two pair of integral dowel pins 60, with one pair thereof extending from each lateral surface 62 and 64 thereof. Accordingly, each set of dowel pins 60 is adapted to extend into a corresponding set of pre-drilled alignment bores (not shown) that are formed in lower frame portion 34 of either side frame member 16. As seen, rocker block 30 is configured to include a upper longitudinal segment 66, a lower longitudinal segment 68 and a plurality of cross-segments 70 which interconnect upper segment 66 and lower segment 68 for producing a series of randomly sized and oriented open channels 72. In addition, it is contemplated that one or more lateral webs (not shown) parallel to lateral surfaces 62 and 64 and connecting upper and lower segments 66 and 68 may be employed in rocker block 30 to provide additional structural rigidity. If a single lateral web is provided it will be centered between lateral surfaces 62 and 64. Dowel pins 60 are shown to be formed to extend from generally arcuate lugs 74 which also extend between upper segment 66 and lower segment 68. In the particular embodiment shown, each set of dowel pins 60 is spaced such that each dowel pin 60 is located proximate to one end of rocker block 30. As will be appreciated, the particular molded structure of rocker block 30 is developed to provide the requisite strength, rigidity and load-bearing capacity while concomitantly reducing its overall weight and material costs. In addition, due to the self-lubricating characteristics associated with the plastic material (i.e., greater lubricity compared to wood), a low friction rolling engagement is established between arcuate rocking surface 36 and planar base surface 38 for effectively reducing the propagation of noise while promoting smoother rocking movement.

To provide means for fixing rocker blocks 30 to side frame members 16 of chair frame 12, a series of bores 76*a*, 76*b* and 76*c* are formed to extend through each rocker block 30 for alignment with pre-drilled mounting apertures (not shown) that are formed in lower frame portion 34. As will be appreciated, such alignment of bores 76*a*, 76*b* and 76*c* with the pre-drilled apertures is accomplished upon insertion of one set of dowel pins 60 into their corresponding alignment holes in lower frame portion 34. Preferably, threaded fasteners are driven through the pre-drilled mounting apertures in lower frame portion 34 and into bores 76*a*, 76*b* and 76*c* to rigidly fix each rocker block 30 to its respective side frame member 16. To provide adequate resistance against excessive shear loading, each of mounting bores 76*a*, 76*b* and 76*c* is formed to extend through a thickened portion 78*a*, 78*b* and 78*c*, respectively, of rocker block 30. In addition, bores 76 may be tapped if desired or, alternatively, be slightly undersized to generate a rigid interconnection with the threaded fasteners.

Figure 6:
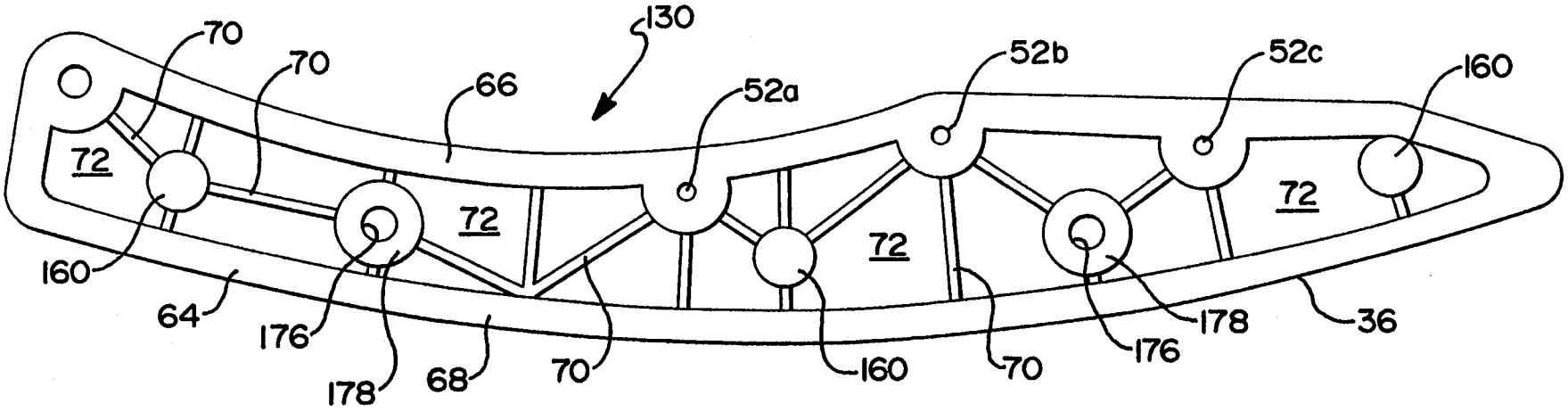
FIG. 6 is a side view illustrating an alternative embodiment for the rocker block of the present invention.

With particular reference now to FIG. 6, an alternative embodiment of a plastic rocker block 130 is shown which essentially embodies the novel principles and features set forth in the previous description of rocker block 30. Thus, like reference numbers are used to designate those components or features of rocker block 130 which are similar in function to those of rocker block 30. In general, rocker block 130 includes a set of three dowel pins 160 which are capable of providing superior loading distribution. Moreover, the mounting arrangement for fixing rocker block 130 to side frame members 16 has been modified to include a pair of mounting bores 176 which are alignable with mounting apertures (not shown) in frame portion 34. Again, thickened portions or enlarged lugs 178 are provided which surround mounting bores 176. Again, suitable threaded fasteners may thus be utilized to rigidly but removably secure rocker block 130 to side frame members 16.

From the foregoing description it should be appreciated that a wide variety of modifications may be made to each rocker block embodiment to suit specific platform rocking chair applications. Thus, skilled practitioners will recognize that the present invention can be implemented in a variety of forms. Accordingly, while the above description constitutes the preferred embodiments of the present invention, it will be appreciated that the present invention is susceptible to modification, variation and change without departing from the proper scope and fair meaning of the accompanying claims.

What is claimed is:

1. In a chair having a base assembly, an upholstered chair frame and a rocking mechanism for permitting rocking movement of said chair frame relative to said base assembly, said rocking mechanism including a rocker block secured to each lateral side of said chair frame's lower frame structure and having an arcuate surface supported for rocking movement relative to a planar surface on said base assembly, and a rocker spring coupling each rocker block to said base assembly for controlling the rocking movement of said chair frame on said base assembly, an improvement wherein said rocker block is a molded plastic component having fastener means including first aperture means for receiving suitable fasteners so as to rigidly secure said plastic rocker block to said lower frame structure and second aperture means for receiving suitable fasteners to couple said rocker spring to said plastic rocker block and having alignment means separate from said fastener means and extending outwardly from said rocker block for engaging a portion of said lower frame structure,

2. The chair of claim 1 wherein said plastic rocker block has a first elongated segment, a second elongated segment and a series of cross-segments interconnecting said first and second elongated segments for defining a plurality of open channels therebetween.

3. The chair of claim 2 wherein said arcuate surface of said plastic rocker block is formed on an outer surface of said first elongated segment.

4. The chair of claim 2 wherein said second aperture means includes a series of mounting bores extending through said second elongated segment of said plastic rocker block.

5. The chair of claim 2 wherein said first aperture means includes a series of mounting bores extending through lug portions formed in at least one of said first and second elongated segments and said cross-segments.

6. The chair of claim 2 wherein said alignment means includes a set of at least two dowel pins which are integrally formed to extend from lug segments interconnecting said first and second elongated segments.

7. The chair of claim 1 wherein said plastic rocker block is made from nylon.

8. The chair of claim 1 wherein said plastic rocker block is made from a fiberglass-filled nylon composition.

9. A rocker block for use in a rocking-type chair having a base assembly and an upholstered chair frame, said rocker block being adapted for mounting to a lateral side of said chair frame's lower frame structure and having an arcuate surface engageable with said base assembly for enabling rocking movement of said chair frame relative to said base assembly, an improvement wherein said rocker block is a molded plastic component having fastener means including first aperture means for receiving suitable fasteners so as to rigidly secure said plastic rocker block to said lower frame structure and second aperture means for receiving suitable fasteners to couple a rocker spring to said plastic rocker block, and having alignment means separate from said fastener means and extending outwardly from said rocker block for engaging a portion of said lower frame structure.

10. The rocker block of claim 9 having a first elongated segment, a second elongated segment and a series of cross-segments interconnecting said first and second elongated segments for defining a plurality of open channels therebetween.

11. The rocker block of claim 10 wherein said arcuate surface of said plastic rocker block is formed on an outer surface of said first elongated segment.

12. The rocker block of claim 10 wherein said second aperture means includes a series of mounting bores extending through said second elongated segment of said plastic rocker block.

13. The rocker block of claim 10 wherein said first aperture means includes a series of mounting bores extending through lug portions formed in at least one of said first and second elongated segments and said cross-segments.

14. The rocker block of claim 10 wherein said alignment means includes a set of at least two dowel pins which are integrally formed to extend from lug segments interconnecting said first and second elongated segments.

15. The rocker block of claim 9 wherein said plastic rocker block is made from nylon.

16. The rocker block of claim 9 wherein said plastic rocker block is made from a fiberglass-filled nylon composition.

17. A rocker block for use in a rocking-type chair having a base assembly and an upholstered chair frame, said rocker block being adapted for mounting to a lateral side of said chair frame's lower frame structure and having an arcuate surface engageable with said base assembly for enabling rocking movement of said chair frame relative to said base assembly, an improvement wherein said rocker block is a molded plastic component having fastener means for rigidly securing said plastic rocker block to said lower frame structure and for coupling a rocker spring to said plastic rocker block, and having alignment means separate from said fastener means and extending outwardly from said rocker block for engaging a portion of said lower frame structure.

18. The rocker block of claim 17 further comprising a first elongated segment having said arcuate surface formed thereon, a second elongated segment and a series of cross-segments interconnecting said first and second elongated segments.

19. The rocker block of claim 17 wherein said alignment means includes a set of at least two dowel pins which are integrally formed to extend from said rocker block.

20. The rocker block of claim 17 wherein said plastic rocker block is made from nylon.

* * * * *